US008316896B2

(12) United States Patent
Revirand et al.

(10) Patent No.: US 8,316,896 B2
(45) Date of Patent: Nov. 27, 2012

(54) FILLING DEVICE FOR AT LEAST TWO GRANULAR MATERIALS AND FILLING METHOD USING SUCH A DEVICE

(75) Inventors: Pascal Revirand, Saint Egreve (FR); Luc Federzoni, Bourgoin-Jallieu (FR)

(73) Assignee: Commissariat a l'Energie Atomique, Paris (FR)

( * ) Notice: Subject to any disclaimer, the term of this patent is extended or adjusted under 35 U.S.C. 154(b) by 581 days.

(21) Appl. No.: 12/600,061

(22) PCT Filed: May 21, 2008

(86) PCT No.: PCT/EP2008/056229

§ 371 (c)(1),
(2), (4) Date: Nov. 13, 2009

(87) PCT Pub. No.: WO2008/142092

PCT Pub. Date: Nov. 27, 2008

(65) Prior Publication Data

US 2010/0320223 A1 Dec. 23, 2010

(30) Foreign Application Priority Data

May 23, 2007 (FR) ..... 07 55223

(51) Int. Cl.
*B65B 1/00* (2006.01)

(52) U.S. Cl. ..... 141/9; 141/100

(58) Field of Classification Search ..... 141/9, 72, 141/79, 100, 105, 285
See application file for complete search history.

(56) References Cited

U.S. PATENT DOCUMENTS 3,545,503 A * 12/1970 Sigeru et al. ..... 141/286
2008/0264517 A1 10/2008 Revirand et al.

FOREIGN PATENT DOCUMENTS

| | | |
|---|---|---|
| BE | 899 420 A2 | 7/1984 |
| FR | 2 882 029 A1 | 8/2006 |
| SU | 609 633 | 5/1978 |

* cited by examiner

*Primary Examiner* — Gregory Huson
*Assistant Examiner* — Jason K Niesz
(74) *Attorney, Agent, or Firm* — Oblon, Spivak, McClelland, Maier & Neustadt, L.L.P.

(57) ABSTRACT

A filling device, enabling simultaneous filling with at least two granular materials, without mixing them, includes an inner hopper supplying a first type of material and an outer hopper supplying a second type of material, and a dispenser arranged downstream from the hoppers. The dispenser includes a central passageway arranged directly opposite the inner hopper, and a deflecting mechanism towards the exterior of the dispenser arranged directly opposite the outer hopper. The deflecting mechanism at least partially borders the central passageway. The dispenser is capable of rotating about a longitudinal axis, the direction of which is the mean direction of flow, in which the dispenser includes a central shaft including an upper end opposite the inner hopper forming a deflecting surface for the first type of material coming from the inner hopper.

13 Claims, 6 Drawing Sheets

FILLING DEVICE FOR AT LEAST TWO GRANULAR MATERIALS AND FILLING METHOD USING SUCH A DEVICE

TECHNICAL FIELD AND PRIOR ART

This invention relates primarily to a device for filling a container with at least two materials in granular form, and to a filling method using such a device.

The filling of containers, e.g., pressing dies, with granular materials is usually carried out by means of a pipe of circular section, which is connected at an upper end to a tank of granular material. Such being the case, materials of the granular type can have poor flowability, due to the particle-size distribution thereof, the intrinsic surface roughness thereof and/or the density thereof. This type of filling is thus not satisfactory for ensuring uniform filling of the mould, and all the more so in the case of moulds of complex geometry.

It has been proposed to improve the flowability of the materials via the fluidisation of same, e.g., by means of a current of air. However, the means to be implemented are complex.

The document FR 2 882 029 describes a device for filling with a granular material which enables a die of complex shape to be filled. This device comprises a rotating body comprising a central passageway surrounded by a deflector; based on the rotational speed of the body, it is possible to control the quantity of material deflected towards the exterior of the body or following the passageway, thereby enabling the filling consistency of a die, even if complex in shape, to be improved with a relatively simple device. This device provides complete satisfaction, however it does not enable simultaneous filling to be carried out with two granular materials without mixing the two materials.

It is therefore an objective of this invention to offer a filling device and a filling method enabling filling with at least two unmixed granular materials, the filled container comprising regions formed by each of the materials alone.

It is likewise an objective of this invention to offer a filling device enabling uniform filling of any type of container, even if it is of complex shape.

DISCLOSURE OF THE INVENTION

The aforesaid objectives are achieved by a filling device comprising a hopper enabling several granular materials to be supplied separately, and a rotating body provided with a central channel for the passage of a first type of materials, and deflecting means surrounding the central channel for deflecting a second type of material, filling with the two types of material being carried out without mixing them. It is thus possible, e.g., in the case of manufacturing parts using die-pressing technology, to produce parts comprising regions of different materials, by simultaneously filling with various components and without mixing them.

In other words, the device comprises means of separately bringing at least two types of materials directly opposite separate locations of a distribution means, this distribution means controlling the filling operation without mixing the materials.

This invention likewise enables the flow rates of the various components to be controlled.

In addition, the device according to this invention enables good filling repeatability.

The primary subject-matter of the present invention then is a filling device enabling simultaneous filling with at least two granular materials, without mixing them, which comprises a hopper assembly and a dispenser arranged downstream from the hopper assembly in a direction of flow, the hopper assembly comprising at least two hoppers, an inner hopper for supplying a first type of material, and an outer hopper for supplying a second type of material, the dispenser comprising a central passageway arranged directly opposite the inner hopper and the means of deflecting the second type of material towards the exterior of the dispenser, which are arranged directly opposite the outer hopper, said deflecting means at least partially bordering the central passageway, the dispenser being capable of rotating about a longitudinal axis the direction of which is the mean direction of flow.

The adjectives "inner" and "outer" qualify the position of the hoppers relative to one another and do not limit the invention to a geometric position of the hoppers in relation to the geometric shape of the device according to the invention.

The deflecting means can have a crown shape the reflecting surface of which is a concave toric, or a crown shape the reflecting surface of which is a V-shaped transverse section.

The dispenser can comprise a central shaft having a longitudinal axis connected to a wall of the central passageway via blades, thereby enabling easy connection to driving means.

The blades are advantageously contained in planes which are inclined relative to the x-axis, which improves the particle distribution of the granular materials.

The dispenser can comprise a central axis of which an upper surface opposite the inner hopper forms a deflecting surface for the first type of material, this deflecting surface, for example, has a V-profile or U-profile.

The hopper assembly can comprise a central channel forming the inner hopper and a peripheral channel forming the outer hopper.

The outer channel is continuous, for example, in order to form a succession of adjacent channels.

A subject-matter of the present invention is also a method of filling a container by means of a filling device according to this invention, comprising the steps of:

a) introducing the dispenser into an upper region of the container, b) rotating the dispenser about the longitudinal axis, c) supplying the dispenser with the two types of material via the hopper assembly.

The method can advantageously comprise the step of adjusting the rotational speed of the dispenser and/or the flow areas of one or both of the hoppers during filling.

The rotational speed is advantageously set to a value which enables an identical flow rate for both types of material.

BRIEF DESCRIPTION OF THE DRAWINGS

This invention will be better understood with the aid of the following description, and from the appended drawings, in which.

DETAILED DISCLOSURE OF PARTICULAR EMBODIMENTS

Figure 1A:
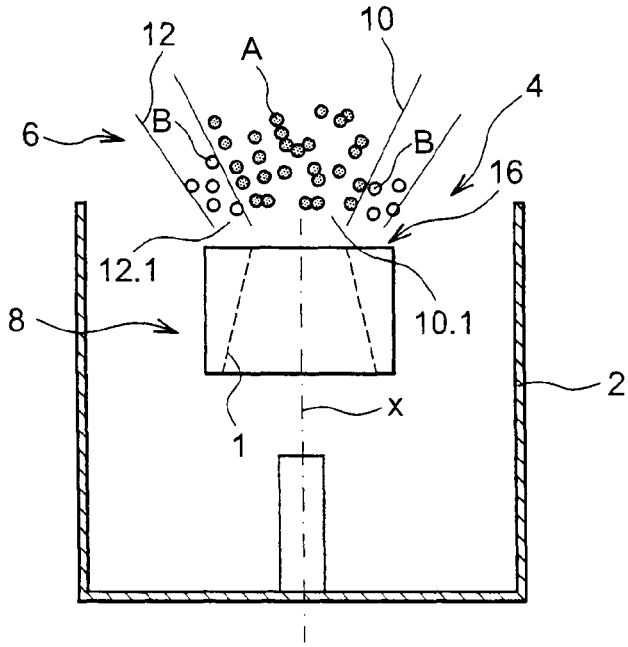
FIGS. 1A to 1D are schematic diagrams of a filling device according to this invention in four filling phases.

In this disclosure, granular-type materials are understood to be any materials formed from a set of separate elements of uniform or variable sizes, e.g., between a few nanometers and several centimeters. Powdered materials are, of course, covered by this expression.

The following description is made in connection with the filling of a die or die cavity for producing parts by compression. However, this invention applies to any type of filling wherein simultaneous filling is desired, using several granular materials but without mixing same.

Various steps for filling a die 2 by means of a filling device 4 according to the invention are shown schematically and can be seen in FIGS. 1A to 1D.

The device comprises a feed hopper assembly 6 enabling several types of granular materials, two in the example shown, which are to be brought level with a means for dispensing 8 these materials without mixing them. Each of the hoppers can be formed of separate compartments containing different materials, for the purpose of mixing them at the time of filling.

The hopper assembly comprises a first hopper 10 formed by a central channel 10 for supplying a first type of material A, and a second hopper formed by a peripheral channel 12 bordering the central channel 10, for supplying a second type of material B. The peripheral channel 12, for example, has a ring shape or is formed by a succession of circumferentially distributed channels.

The first type of granular material A is diagrammed by grey balls, and the second type of granular material B is shown by white balls.

In the example shown, the central channel 10 and the peripheral channel 12 have a conical shape with a common axis, which forms a funnel. However, it could be anticipated for them to have a cylindrical shape, or for only one of the two to have a conical shape and the other a cylindrical shape.

Figure 3A:
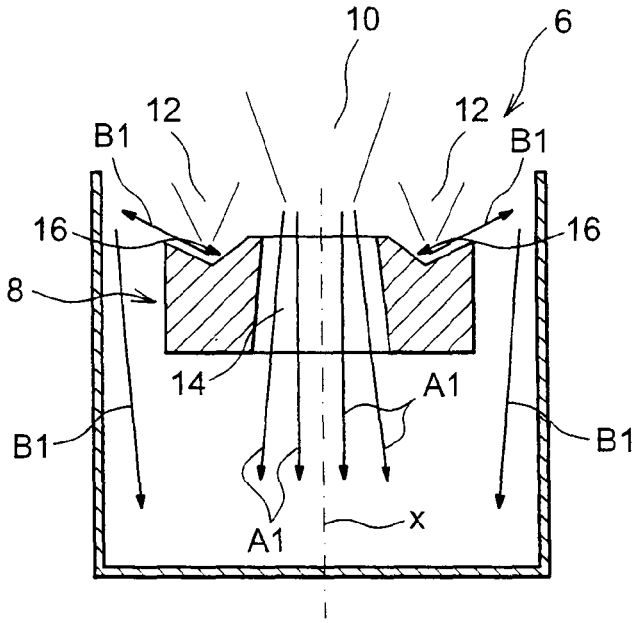
FIGS. 3A and 3B are schematic sectional views of the device of FIG. 2B during filling.
Figure 3B:
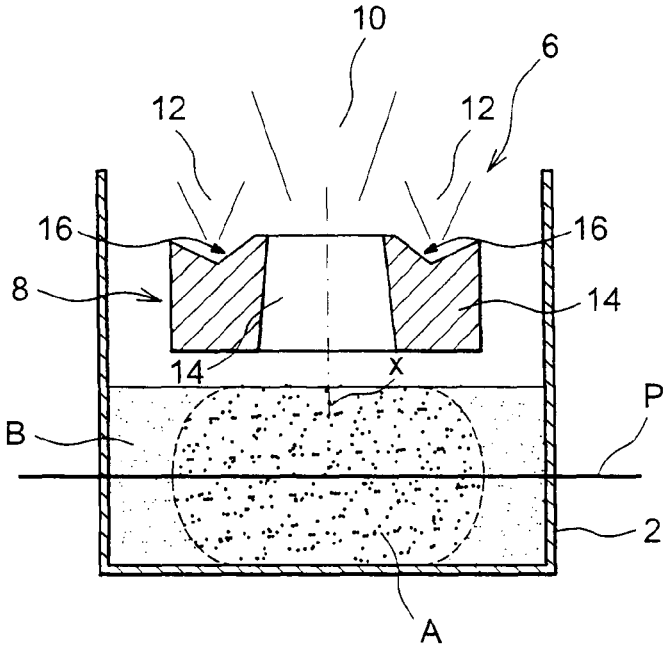

It is likewise possible to use two separate hoppers, i.e., in which the wall of the central channel 10 does not form the interior wall of the peripheral channel 12, as is shown in FIGS. 3A and 3B, which will be described in detail below.

The dispensing means 8 is arranged beneath the feed hopper 6, and the dispensing means is capable of being driven in rotation about a longitudinal x-axis. The x-axis has a direction which is the mean direction of flow. The mean direction of flow is understood to mean the general direction of the material particles, which runs from the hopper assembly 6 to the bottom of the container, which, in the example shown, is the vertical direction.

The dispensing means comprises a central passageway 14 directly opposite a lower end 10.1 of the central channel 10 of the hopper 6, for guiding the first type of material A towards a central region A3 of the die 2.

The dispensing means likewise comprise deflecting means 16 surrounding the central passageway 14. Means 16 are intended to deflect the particles of granular material B towards the exterior while moving away from the x-axis.

The deflecting means 16 are advantageously evenly distributed about the central passageway 14 and surround the central passageway 14 continuously, thereby enabling homogeneous filling in an outer region B3 of the die 2 container, surrounding the central region A3.

The deflecting means 16 are situated directly opposite a lower end 12.1 of the peripheral channel 12 for the second type of material B.

In the example shown, the rotational axis of the dispensing means 8 and that of the central passageway 14 are coincident, however provisions could be made for them to be separate.

In addition, the central passageway 14 has been shown in the form of a cone having a downwardly oriented taper, however a cylindrical shape may be suitable. The shape is chosen so as to control the pathway that one wishes to impose upon the powder.

The various filling steps using the device according to this invention will now be described.

In FIG. 1A, the dispenser 8 is placed inside the die 2 in the upper portion thereof, the hopper assembly being situated above the ends 10.1 of the central channel 10 and 12.1 of the peripheral channel 12 of the hopper, directly opposite the central passageway 14 of the deflecting means 16. The central channel 10 and the peripheral channel 12 are filled with materials A and B, respectively.

Figure 1B:
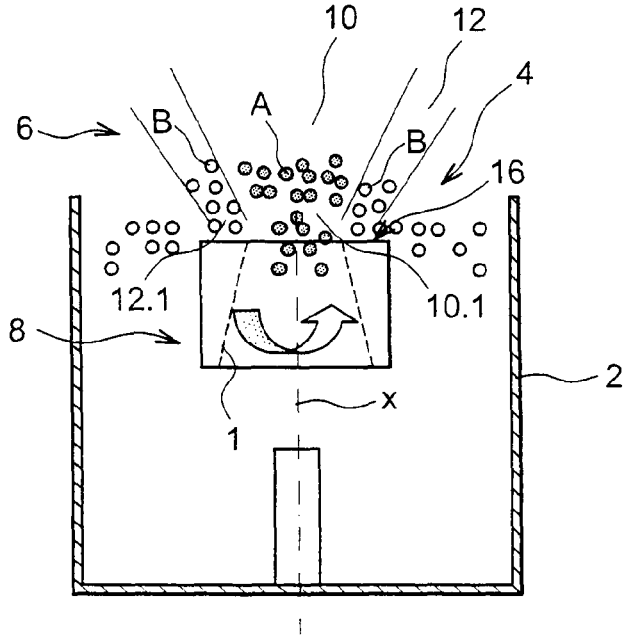

In FIG. 1B, the dispenser is rotated about the x-axis and the materials A and B flow towards the dispenser 8. The rotation is symbolised by the arrow 15.

Material A flows into the central passageway 14 and the particles of material B are deflected radially outward while moving away from the x-axis.

Figure 1C:
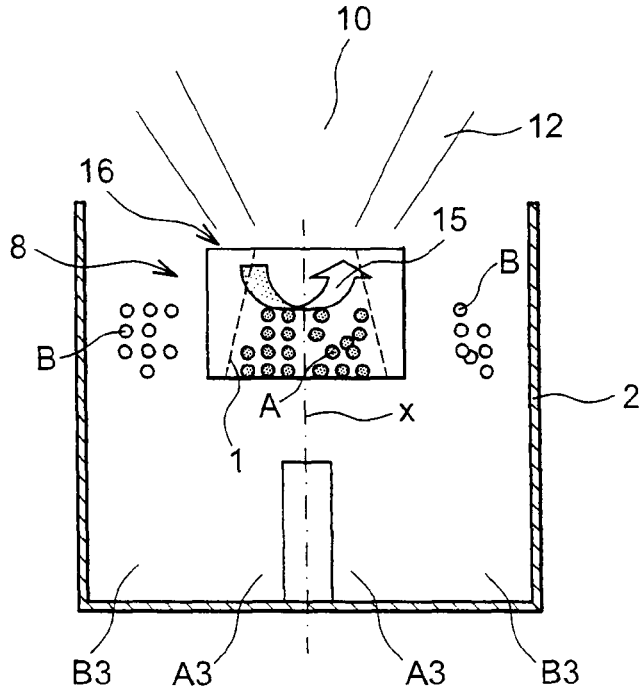

In FIG. 1C, a portion of these particles strike against the interior wall of the die 2 and is deflected a second time; the other portion falls directly into the bottom of the die 2.

Figure 1D:
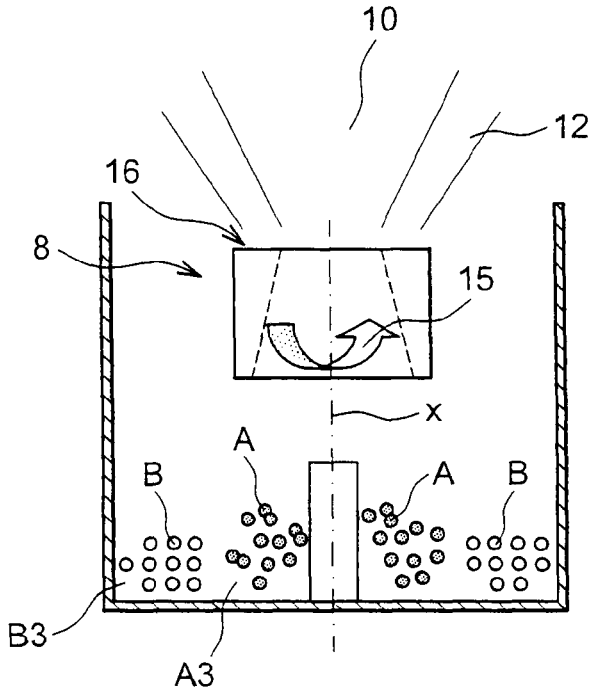

In FIG. 1D, which diagrams the end of the filling operation, the distribution of particles A and B can be seen, which is obtained by means of the device of this invention.

It is likewise possible for the dispenser to be arranged near the bottom of the die 2 at the start of the filling operation, and to rise along the x-axis during filling. In this way, by controlling the height, the pathway is controlled and thus the accuracy of the filling operation.

The central region A3 of the die comprises only material A and the peripheral region B3 comprises only material B.

Thus, owing to this invention, it is possible to obtain a filling with several unmixed granular materials.

Figure 2A:
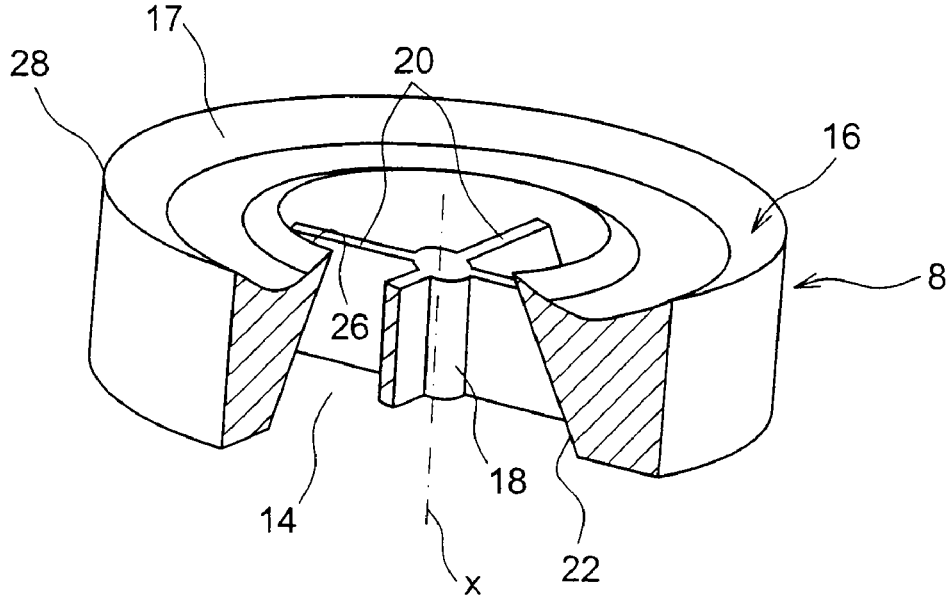
FIGS. 2A and 2B are perspective views of two exemplary embodiments of a filling device according to this invention.

In FIG. 2A, a first exemplary embodiment of a dispenser according to this invention can be seen.

The dispenser comprises a central shaft 18 of axis X, which is rigidly connected to the wall 22 of the central passageway 14 by connection means 20.

The shaft 18 is engaged with a rotating driving means (not shown), which enables the dispenser to be rotated.

In the example shown, the connection means 20 are in the form of flat blades contained in a plane containing the x-axis; the latter number four, however arms could likewise be anticipated.

The blades are advantageously inclined in relation to the x-axis so as to improve the flow of the granular material A.

In this example, the deflecting means 16 are formed by a concave toric crown 17, the bottom being defined by an arc of circle, when viewed as a cross-section.

The crown is defined by a radially inner circular border 26 and a radially outer circular border 28.

In the example shown, the radially inner border 26 is arranged vertically below the radially outer border 28. However, this is in no way limiting; the two borders could be of the same height, or the radially inner border 26 could be arranged vertically above the radially outer border 28.

Figure 2B:
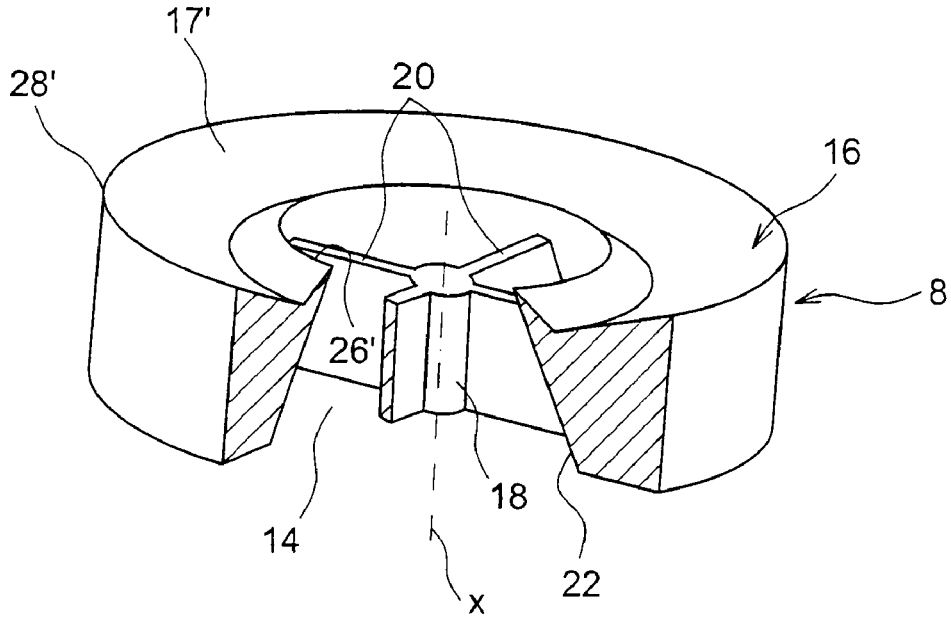

The same embodiment of the dispenser shown in FIG. 2B differs from the device of FIG. 2A in that the deflecting means 16 are formed by a crown 17' having a V-shaped cross-section.

The crown is defined by a radially inner circular border 26' and a radially outer circular border 28'.

In the example shown, the radially inner border 26' is arranged vertically below the radially outer border 28'.

Figure 4:
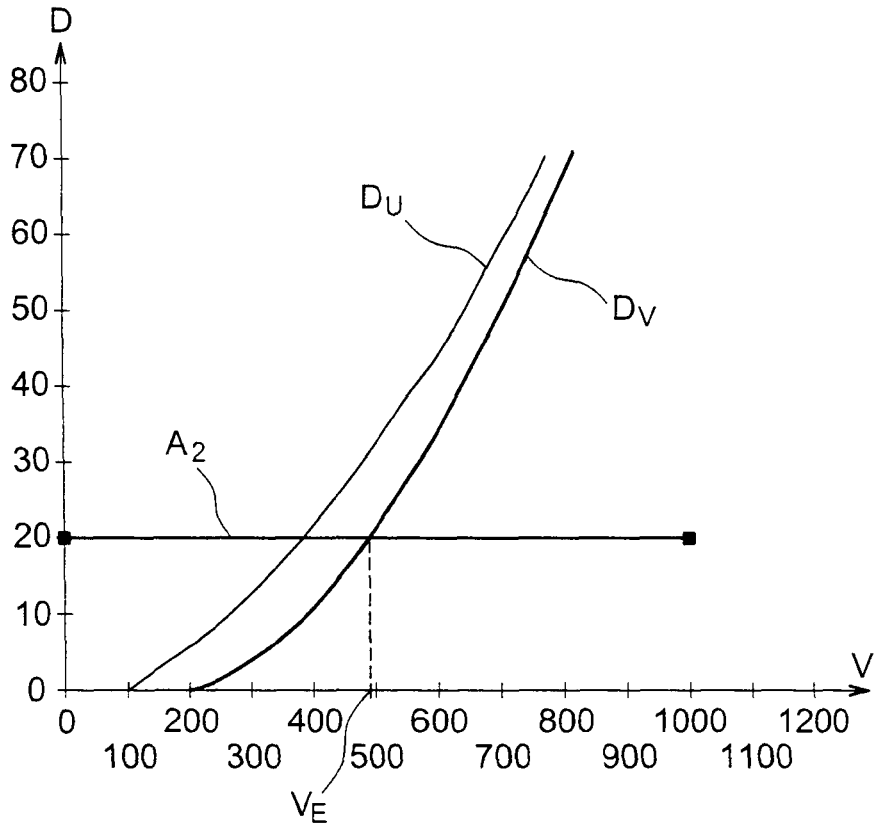
FIG. 4 is a graphic representation of the change in the flow rate, for each of the materials, in relation to the rotational speed of the filling device according to the invention.

Based on the rotational speed V, the V-shaped and U-shaped cross-sections offer different changes in the flow rate, $D_V$ and $D_U$, respectively, as shown in FIG. 4, which enables the speed to be adapted.

In FIG. 3A, the device according to the second exemplary embodiment of the dispenser of FIG. 2B can be seen, as it is being filled.

The arrows designated by A1 symbolise the path of the particles of material A, and the arrows designated by B1 symbolise the path of the particles of material B.

Furthermore, the quality of the resulting filling operations depends on the management of the flow rates for granular materials A and B.

Owing to this invention, the flow rates of material A and material B can be controlled separately.

For example, it is possible to control the flow rate by controlling the flow areas of the hoppers. In this case, the flow rates will be constant throughout the entire filling phase. The filling operations are then not evolutionary over time, and are thus constant over height.

Hoppers can have a variable flow area.

In order to manage the flow rates, the invention enables the flow rate of material B to be regulated separately from the flow rate of material A.

It is likewise possible to anticipate the type of filling possible by using the changes in the flow rate for each of the materials A and B in relation to the rotational speed of the dispenser, these changes being shown in FIG. 4.

The speed V is in RPM and the flow rate D is in g/s, material A is stainless steel and material B is iron powder.

The straight line A2 represents the change in the flow rate of material A in relation to speed; the latter appears to be speed-independent, and, as a matter of fact, the speed of the dispenser has no influence on the flow of material A into the central passageway 14.

On the other hand, the variation in the flow rate of material B in relation to the rotational speed of the dispenser is of the polynomial type.

The rotational speed to be used can then be determined automatically.

In the case where the desired volumes to be filled are identical and constant over height, the rotational speed to be used will thus be the point of intersection between the two curves A2 and B2, i.e., a speed $V_E$ of the order of 480 RPM.

If it is desired to modify the distribution of materials A and B over height, it suffices to vary the rotational speed of the dispenser during the filling operation, so as to achieve fillings of the type shown in FIG. 3B, in which the region consisting of material A, when seen as a sectional view, is substantially ellipse-shaped.

Figure 5:
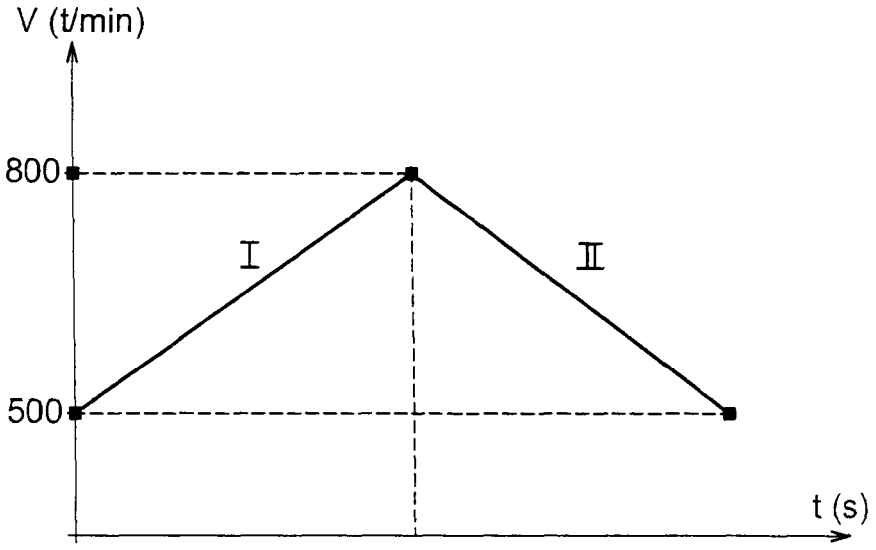
FIG. 5 is a graphic representation of a change in the rotational speed of the dispenser according to the invention, over time, in order to obtain the filling condition of FIG. 3B.

FIG. 5 shows the change in the speed of the dispenser for obtaining the distribution of FIG. 3B. It can be seen that the speed is increased during a first phase I, until reaching the region of largest diameter, and then the speed is reduced until the end of the filling operation, during a second phase II. Since the two phases are of equal duration and the extreme speeds are the same, a symmetrical shape is obtained in relation to a horizontal plane P.

Thus, in order to determine the parameters of the filling method from the volumes involved and the type of distribution desired, it is thus appropriate to return to the rotational speed parameters of the dispenser.

Figure 6:
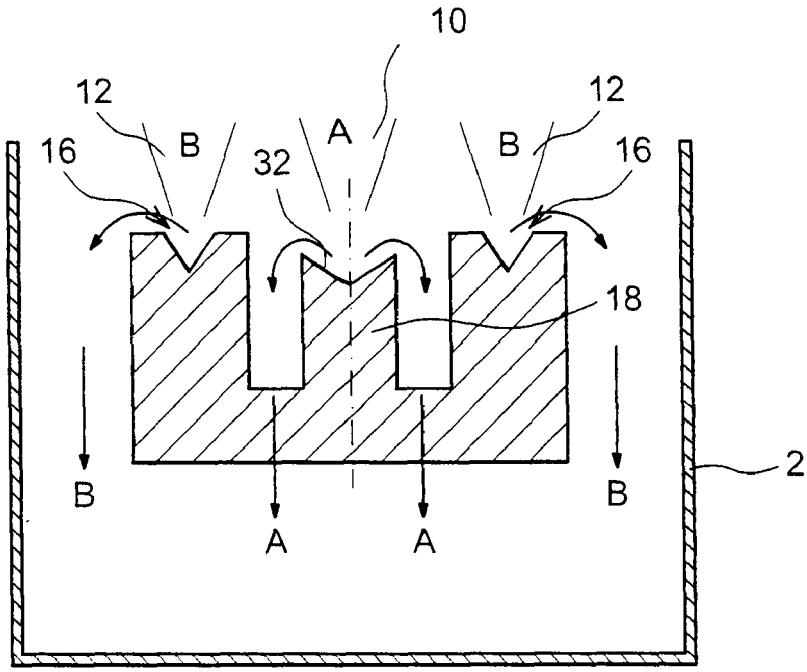
FIG. 6 is a schematic section view of an alternative embodiment of the device according to the invention.

An alternative embodiment of this invention can be seen in FIG. 6, wherein the dispenser comprises a central shaft 18, which, together with the wall, defines an annular channel for the powder A; this central shaft 18, on the upper end thereof and on the side of hopper 10, comprises a deflecting surface 32 for material A. This surface can have a U-profile or a V-profile, i.e., it can have the shape of a bowl with a rounded bottom or a cone-shaped bottom.

This deflecting surface enables the distribution of material A to be improved, as diagrammed in FIG. 6.

In addition, this alternative has the advantage of enabling the hoppers 10, 12 to be kept full outside of the filling operations.

Figure 7:
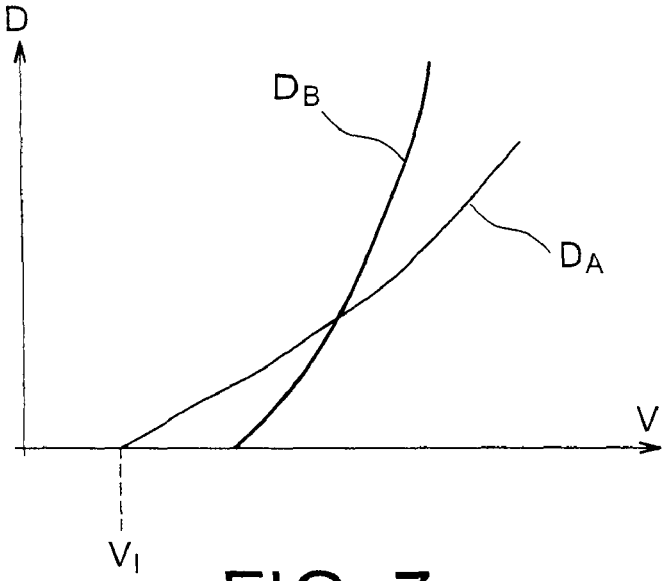
FIG. 7 is a graphic representation of the change in the flow rate of the two materials in relation to the rotational speed of the dispenser according to the invention.

As a matter of fact, when the dispenser is turned off, the powders A and B pile up inside the bowls and end up plugging the openings of the hoppers 10, 12; the flow then stops naturally, without having to empty the hoppers completely, as can be seen in FIG. 7, which shows the change in the flow rate $D_A$ and $D_B$ for each material, A and B, respectively, in relation to the rotational speed V of the dispenser. V1 designates the speed below which the flow rate of material A is zero, i.e., below which the flow of material A is stopped.

Restarting of the filling device is thus faster, and, in addition, there is very little or no longer any lost material since it is no longer necessary to empty the hoppers.

Owing to this invention, it is thus possible to achieve a complex-shaped distribution of each material by controlling the flow rates, e.g., by simply modifying the rotational speed of the dispenser and/or the flow areas of the hopper.

The filling device according to the invention has been described for two materials A and B, however a filling device enabling simultaneous and separate filling of more than two materials does not depart from the scope of this invention.

As a matter of fact, three or more concentric hoppers could be anticipated, and a dispenser provided with a central channel, a peripheral channel and deflecting means surrounding the peripheral channel and each arranged directly opposite a corresponding hopper.

For example, the device can have a diameter of 15 mm and a height of 10 mm, and the grains of the powder used can have a diameter of 150 μm. This device enables a filling of a few grams to several kilograms; the object will then have a volume of between 1 $mm^3$ to 1 $dm^3$.

It is likewise possible to anticipate for the filling device (hopper and dispenser) to rotate about an axis parallel to the x-axis and separate therefrom, and/or to move parallel thereto, so as to achieve even more complex distributions.

The device according to this invention is very simple to produce; in particular, the dispenser, for example, can be made in a single piece, e.g., from plastic or metal; it can be made by sintering, laser-fabricated, machined or moulded.

The motor can be offset from the axis or situated on the axis; for example, it can be held by the shaft of the dispenser in the case where the latter comprises one. In the opposite case, a drive system can also be associated with the dispenser, e.g., of the belt, jaw or pin type.

The invention claimed is:

1. A filling device enabling simultaneous filling with at least two granular materials, without mixing them, the device comprising:

a hopper assembly comprising at least two hoppers of an inner hopper that supplies a first type of material and an outer hopper that supplies a second type of material; and a dispenser arranged downstream from the hopper assembly in a direction of flow and being rotatable about a longitudinal axis the direction of which is the mean direction of flow, the dispenser comprising:

a central passageway arranged directly opposite the inner hopper, a central shaft including an upper end opposite the inner hopper forming a deflecting surface for the first type of material, and a deflector device that deflects the second type of material towards the exterior of the dispenser, arranged directly opposite the outer hopper, the deflector device at least partially bordering the central passageway.

2. A filling device according to claim 1, in which the deflector device has a crown shape and a deflecting surface of which is a concave toric.

3. A filling device according to claim 1, in which the deflector device has a crown shape and a deflecting surface of which has a V-shaped transverse section.

4. A filling device according to claim 1, in which the central shaft of the longitudinal axis is connected to a wall of the central passageway via blades.

5. A filling device according to claim 4, in which the blades are contained in planes that are inclined in relation to the longitudinal axis.

6. A filling device according to claim 1, in which the deflecting surface has a V-profile or a U-profile.

7. A filling device according to claim 1, in which the hopper assembly comprises a central channel forming the inner hopper and a peripheral channel forming the outer hopper.

8. A filling device according to claim 7, in which the peripheral channel is continuous or formed by a succession of separate channels.

9. A filling device according to claim 4, in which the deflecting surface has a V-profile or a U-profile.

10. A filling device according to claim 4, in which the hopper assembly comprises a central channel forming the inner hopper and a peripheral channel forming the outer hopper.

11. A method of filling a container with at least two types of material, by a filling device enabling simultaneous filling with at least two granular materials, without mixing them, which comprises:

a hopper assembly comprising at least two hoppers of an inner hopper for supplying a first type of material and an outer hopper for supplying a second type of material; and a dispenser arranged downstream from the hopper assembly in a direction of flow and being rotatable about a longitudinal axis the direction of which is the mean direction of flow, the dispenser comprising:

a central passageway arranged directly opposite the inner hopper, a central shaft including an upper end opposite the inner hopper forming a deflecting surface for the first type of material and a deflector device that deflects the second type of material towards the exterior of the dispenser, arranged directly opposite the outer hopper, the deflector device at least partially bordering the central passageway, the method comprising:

a) introducing the dispenser into the container;

b) rotating the dispenser about the longitudinal axis; and c) supplying the dispenser with the two types of material via the hopper assembly.

12. A filling method according to claim 11, further comprising adjusting the rotational speed of the dispenser and/or the flow areas of one or both of the hoppers during filling.

13. A filling method according to claim 12, in which the rotational speed is set to a value which enables an identical flow rate for both types of material.

* * * * *